US005167057A

United States Patent [19]

Somerville

[11] Patent Number: 5,167,057

[45] Date of Patent: Dec. 1, 1992

[54] HYDRAULIC PULLER

[76] Inventor: Dean S. Somerville, P.O. Box 246, Cooperstown, N. Dak. 58425

[21] Appl. No.: 872,728

[22] Filed: Apr. 20, 1992

Related U.S. Application Data

[63] Continuation-in-part of Ser. No. 690,630, Apr. 24, 1991, abandoned, which is a continuation-in-part of Ser. No. 349,078, May 8, 1989.

[51] Int. Cl.[5] ..... B25B 27/02

[52] U.S. Cl. ..... 29/252; 29/261; 29/265; 269/17

[58] Field of Search ..... 29/252, 258, 261, 263, 29/264, 265; 269/17

[56] References Cited

U.S. PATENT DOCUMENTS

| | | | |
|---|---|---|---|
| 3,908,258 | 9/1975 | Barty | 29/252 |
| 4,068,365 | 1/1978 | Brandt et al. | 29/261 |
| 4,257,163 | 3/1981 | Bauer | 29/260 |
| 4,583,288 | 4/1986 | Young | 29/261 |
| 4,845,825 | 7/1989 | Gleason | 29/261 |

*Primary Examiner*—J. J. Swann
*Attorney, Agent, or Firm*—David A. Lingbeck

[57] ABSTRACT

A puller is vertically movably mounted on a transport cart and includes a base assembly having at least a pair of puller jaws pivotally mounted thereto. The puller jaws are pivotally moved relative to the base assembly by means of a cam ring which is axially moved with respect to the base assembly by means of a plurality of hydraulic cylinders connected thereto. A hydraulic ram is mounted in the base assembly and has a ram point adapted to engage the end of the shaft upon which the gear is mounted.

7 Claims, 6 Drawing Sheets

HYDRAULIC PULLER

CROSS REFERENCE TO RELATED APPLICATION

This is a continuation-in-part application of continuation-in-part- application Ser. No. 07/690,630 filed Apr. 24, 1991, entitled "Hydraulic Puller", now abandoned which is a continuation-in-part of Ser. No. 07/349,078 filed May 8, 1989 entitled "Hydraulic Puller," allowed Apr. 31, 1992.

BACKGROUND OF THE INVENTION

This invention relates to a hydraulic puller system and more particularly to a hydraulically powered puller system including a hydraulically operating camming assembly.

Hydraulic puller devices have heretofore been known, as illustrated in U.S. Pat. Nos. 2,303,560, 4,007,535 and 4,068,365. As stated in the parent application, the '535 patent suggests manufacturing a hydraulic cylinder in a center bore in place of a threaded rod. Manufacturing hydraulic components within a center bore is difficult and expensive. The hydraulic puller device, and one specifically having an externally threaded hydraulic cylinder for a jaw assembly is illustrated in U.S. Pat. No. 1,581,057. Still other hydraulic pullers have been placed on the market are believed to lack convenient locking or camming of puller elements and generally required awkward draw assembly and awkward arrangements for the components.

As also stated in the parent application, all prior art puller teachings have totally failed to address and have not suggested the formation of a hydraulically powered locking puller which permits easy discrete separation of the entire hydraulic system from remaining parts of the locking puller without need to dismantle the hydraulic system and without need to dismantle or loosen or adjust any other part or assembly of parts of the locking puller.

Although the device of the parent application is believed to overcome the shortcomings of the prior art, the instant invention represents an improvement over the invention of the parent application in that the puller device of this invention is much larger than the earlier device and the camming ring is hydraulically operated for conveniently and securely hydraulically locking the camming ring into position so that the jaw members are positively locked into the gear or the like which is to be pulled.

The hydraulic operation of the camming ring of the instant invention permits the device to be quickly and easily secured to the gear to be pulled to be quickly and easily removed therefrom Further, the instant invention is of the heavy-duty type which is capable of exerting at least one hundred tons of hydraulic pressure on the gear to be removed. Further, the hydraulic puller in this invention is mounted on a transport cart to enable it to be easily moved from one location to another.

It is therefore a principal object of the invention to provide an improved hydraulic puller device.

Still another object of the invention is to provide a hydraulic puller device including a hydraulically operated cam ring assembly.

Still another object of the invention is to provide a hydraulic puller device which is mounted on a transport cart and which includes means for raising and lower the puller device relative to the cart.

Still another object of the invention is to provide a hydraulic puller device which may be conveniently lifted by a forklift or the like into position relative to the gear or the like to be pulled.

Still another object of the invention is to provide a hydraulic puller device wherein the hydraulic module may be easily removed from the remaining assembly.

Still another object of the invention is to provide a hydraulic puller including a primary cylinder having approximately a one hundred ton capacity.

Yet another object of the invention is to provide a hydraulic puller device which is vertically movably mounted on a transport cart to enable the puller to be raised to the transport cart.

Still another object of the invention is to provide the hydraulic puller device which is economical of manufacture, safe to use and aesthetic in appearance.

These and other objects will be apparent to those skilled in art.

SUMMARY OF THE INVENTION

Figure 1:
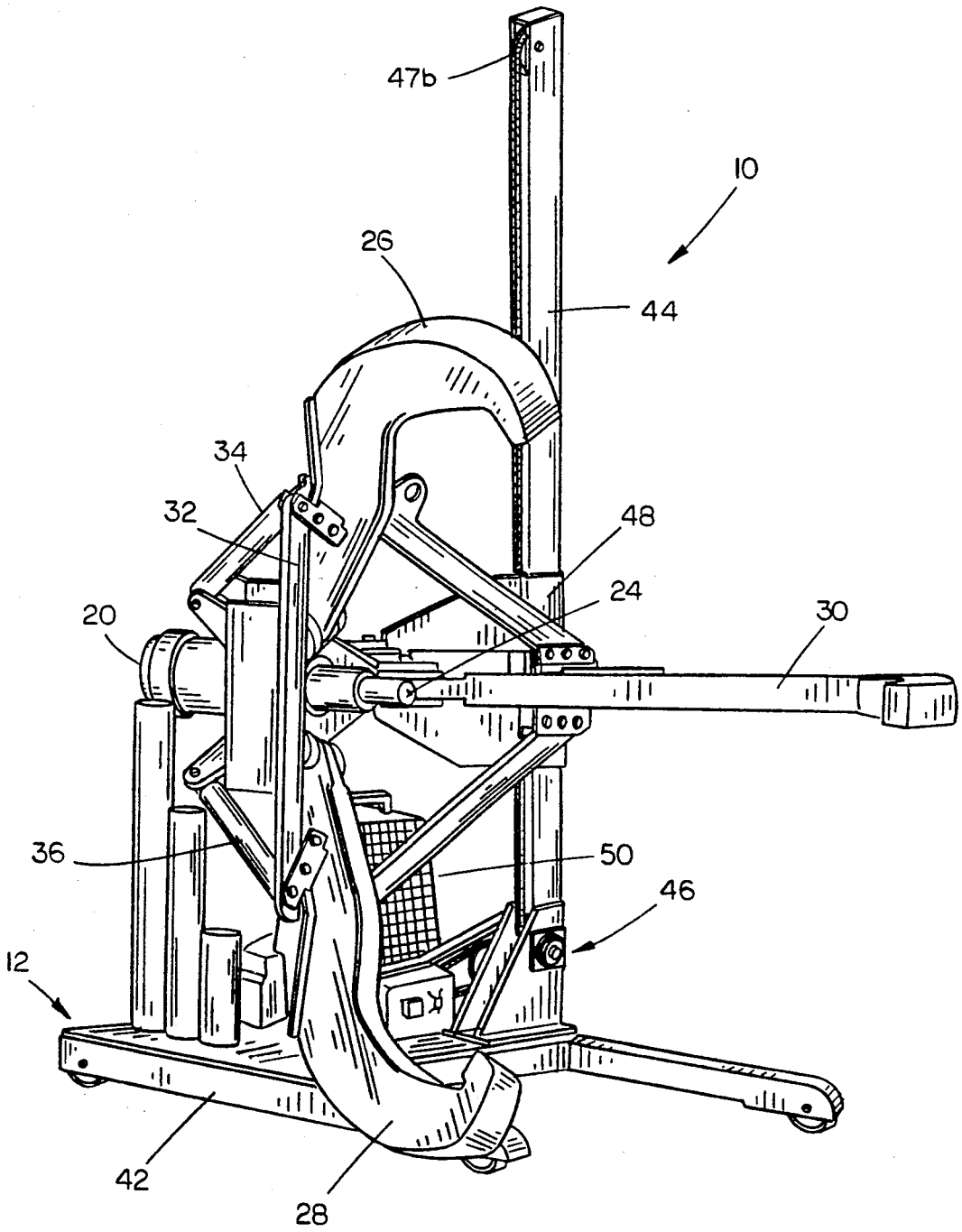
FIG. 1 is a front perspective view of the hydraulic puller of this invention.
Figure 2:
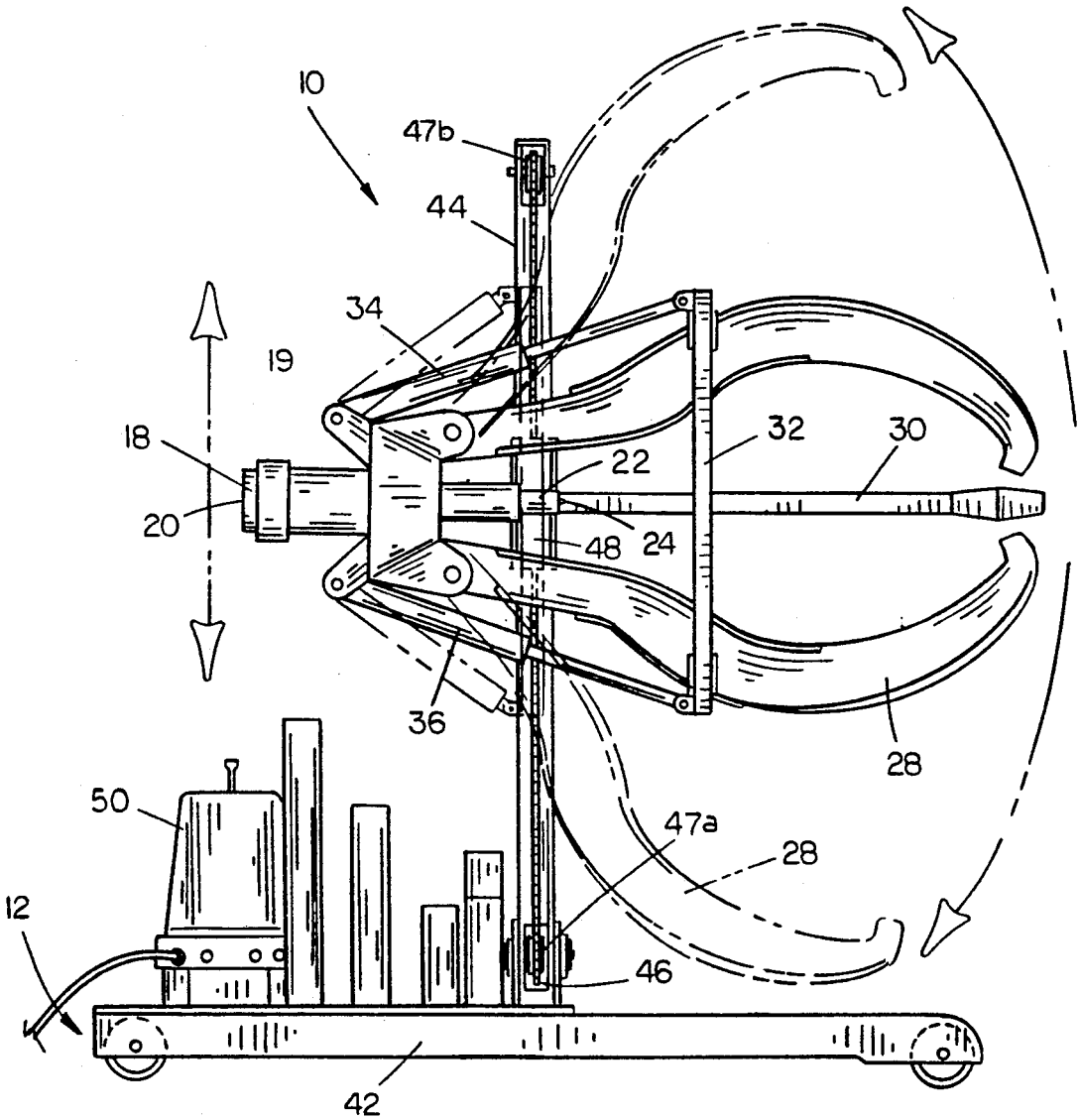
FIG. 2 is a side view of the puller device of this invention.

The hydraulic puller of this invention comprises a portable transport cart having a vertically disposed frame member upon which the hydraulic puller portion of the invention is vertically movable. A base assembly is operatively vertically movably secured to the upstanding frame member and has a central bore extending therethrough and into which is mounted a one hundred ton hydraulic cylinder having its ram extending longitudinally therefrom in an axial manner. A plurality of spaced apart jaws are pivotally connected at one end to the base assembly and are movable in a radial fashion with respect to the base assembly by means of a cam ring operatively mounted thereon. The plurality of hydraulic cylinders are operatively secured to and extend between the base assembly and the cam ring for hydraulically moving the cam ring with respect to the jaws so that the jaws may be opened or closed and may be hydraulically locked into pulling position by the hydraulic cylinder. The puller device may be raised or lowered relative to the transport cart so that the puller device may be aligned with the gear to be pulled. The entire transport cart may be also raised by means of a forklift truck if so desired. Further, the puller device itself may be physically removed from the transport cart and lifted into position by means of a bridge crane or the like.

DESCRIPTION OF THE PREFERRED EMBODIMENT

The puller device of this invention is referred to generally by the reference numeral 10. The puller device 10 is normally mounted on a portable transport cart 12 as will be described in more detail hereinafter but it should be noted that the puller device 10 may be removed from the cart 12 and moved into position by means of a bridge crane or the like as will also be described in more detail hereinafter.

The puller device 10 is essentially the same puller device as that disclosed in the parent application, Ser. No. 07/349,078, which is incorporated herein by reference. The principal difference between the puller device 10 of this invention and the puller device of the parent application is that it has much greater capacity and the cam ring is hydraulically operated rather than manually operated. Further, the puller device of this invention is mounted on a portable transport cart.

Figure 7:
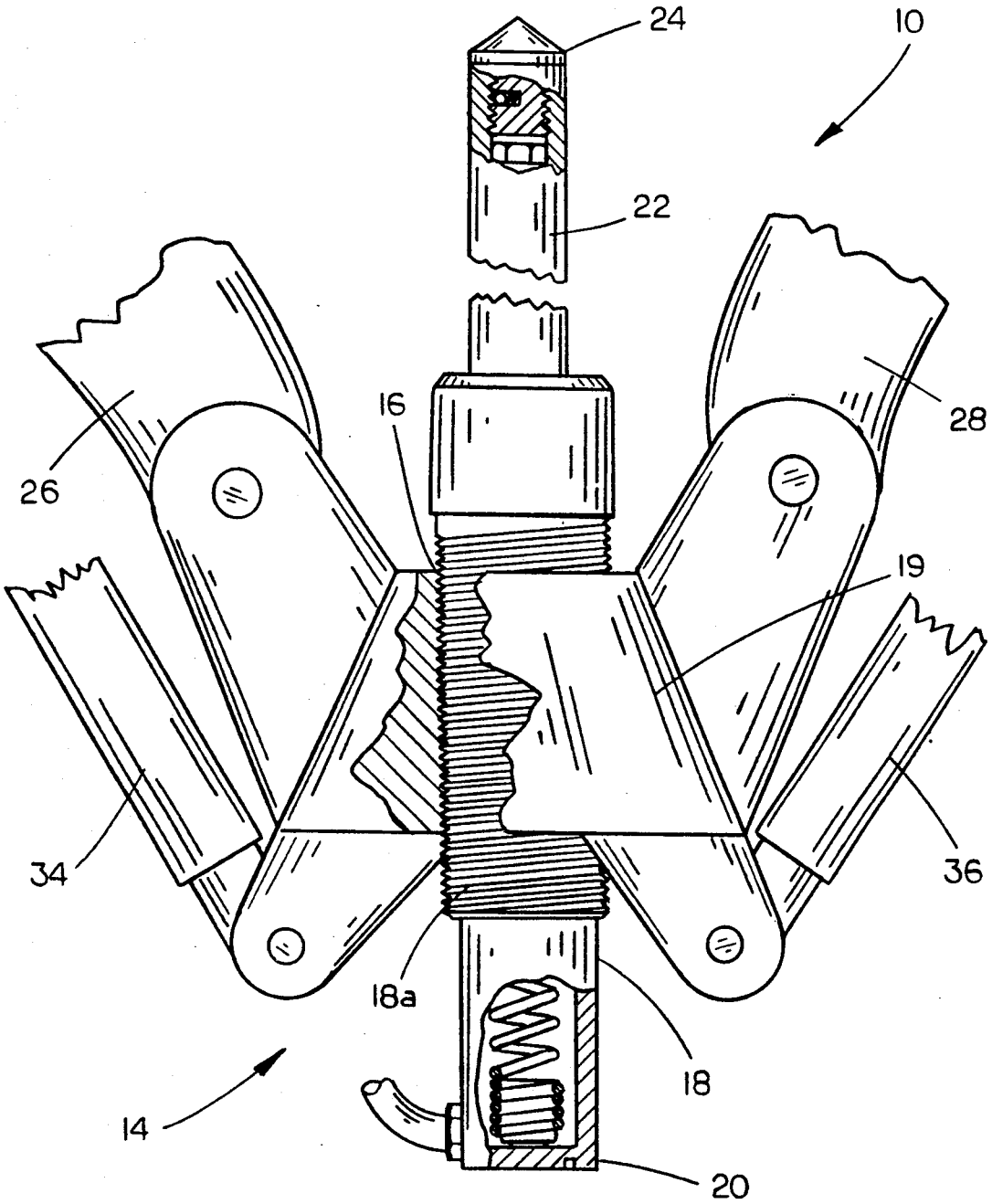
FIG. 7 is an enlarged partial sectional view of FIG. 3.

As shown in FIG. 7, puller device 10 includes a base assembly 14 having a housing 19 with an elongated, interiorly threaded cylindrical bore 16 formed therein into which is mounted a one hundred ton hydraulic cylinder 18 including a butt or base end 20 and a hydraulic ram 22 movably extending from the head end thereof. A pushing adapter 24 is removably secured to the outer end of the ram 22. Hydraulic cylinder 18 has an exteriorly threaded portion 18*a* which is threaded into the interiorly threaded housing 19 of the base assembly 14 in the same manner as the parent application so as to permit the entire hydraulic cylinder 18 to be quickly and easily removed from the base assembly 14 as needed.

Figure 5:
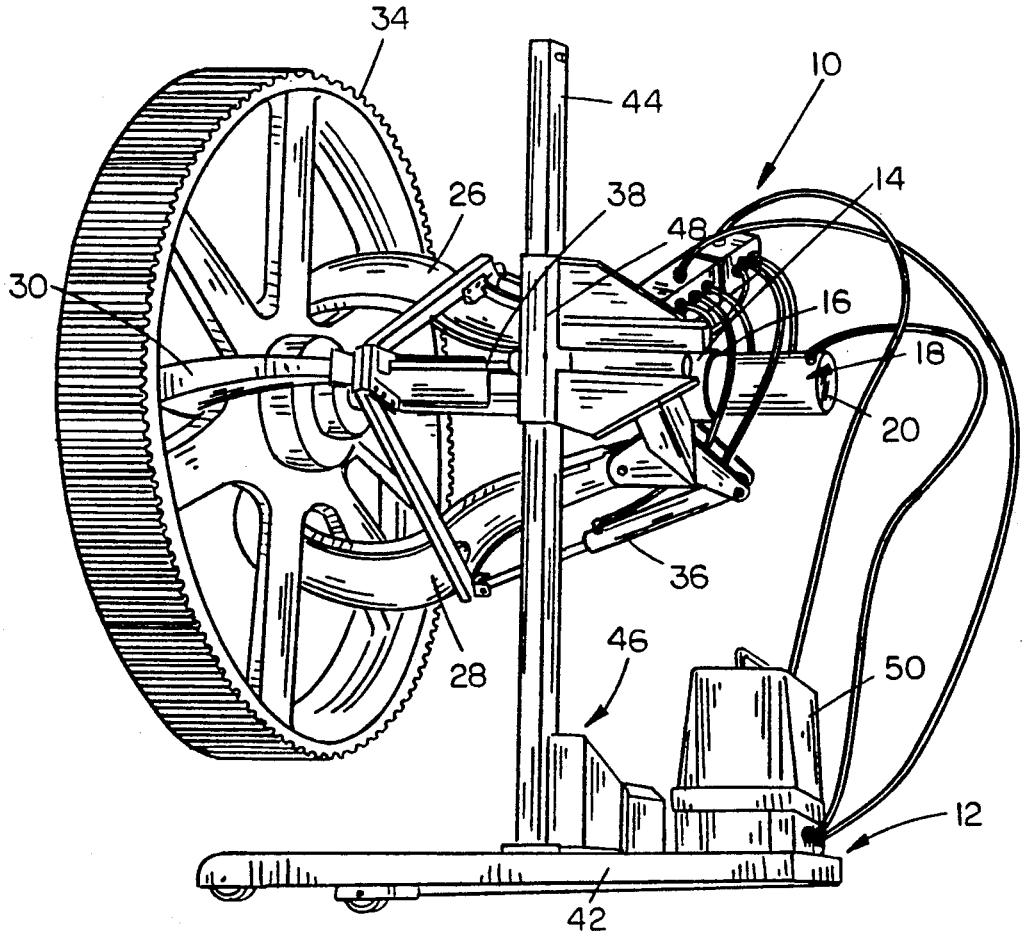
FIG. 5 is a perspective view illustrating the apparatus being used to pull a gear from a shaft.
Figure 6:
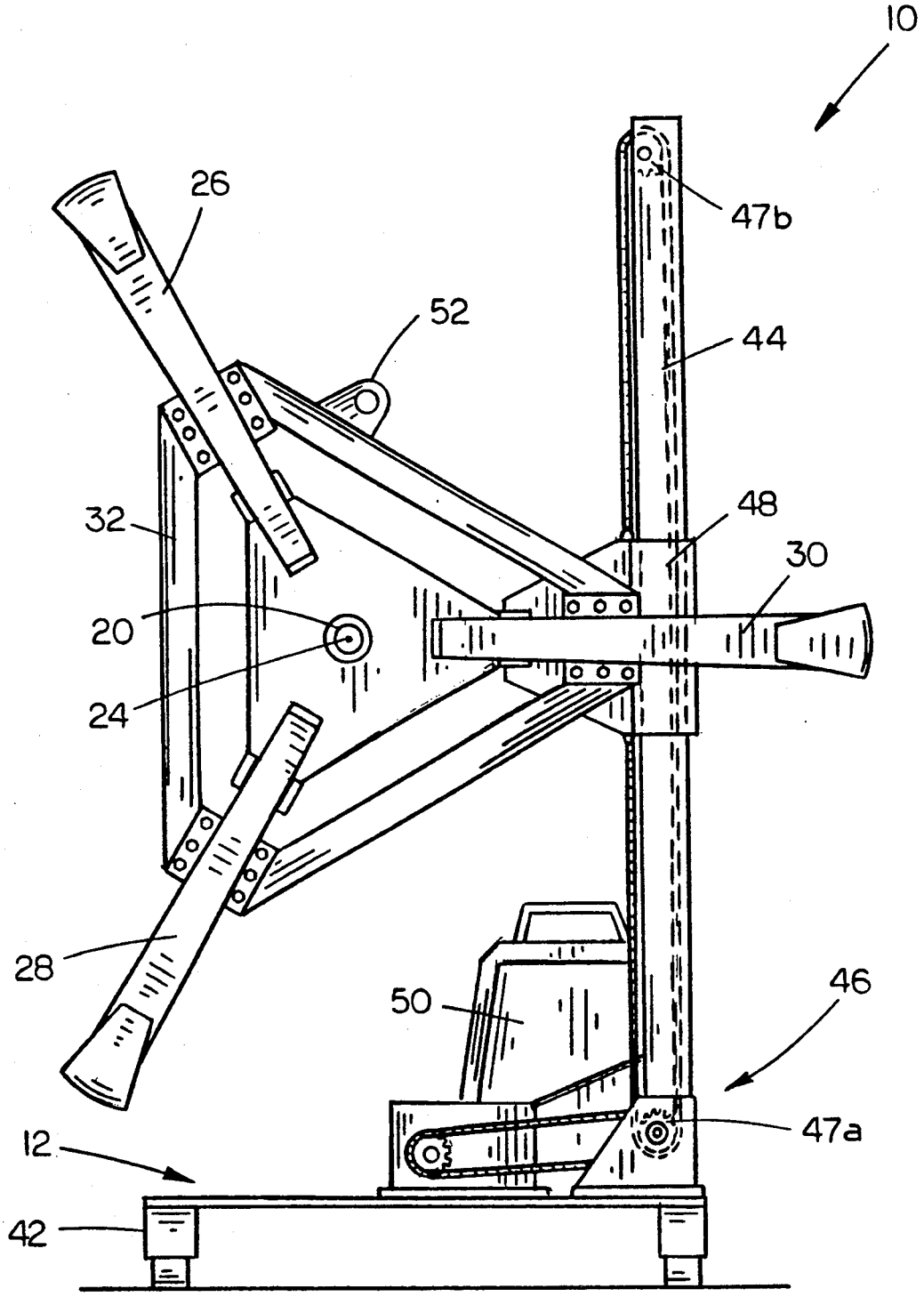
FIG. 6 is a front view of the device.

Arcuate jaws 26, 28 and 30 are pivotally connected at their rearward ends to the base assembly 14 as illustrated in FIG. 5 and have a cam ring 32 embracing ridges on the jaws in the same fashion as in the parent application. Thus, longitudinal movement of the cam ring 32 relative to the base assembly 14 causes the jaws 26, 28 and 30 to pivotally move in a radial fashion relative to base assembly 14 and the gear 34 or the like. Hydraulic cylinders 34, 36 and 38 are pivotally connected at one end thereof to base assembly 14 and are pivotally connected at their rod or ram ends to cam ring 32 to cause cam ring 32 to move longitudinally relative to base assembly 14 to cause the jaws 26, 28 and 30 to pivotally move in a radial fashion.

As stated, the numeral 12 refers to a portable transport cart including a wheeled base 42 having an upstanding post or frame member 44. A power lift assembly 46 includes a motor-driven lower sprocket 47*a* mounted on the lower end of post 44, an upper idler sprocket 47*b* mounted on the upper end of post 44, and an endless loop chain connected around sprockets 47*a* and 47*b*. A mast 48 includes a sleeve-like portion slidably mounted on past 44 and removably connected to one side of the loop of the chain for vertical movement therewith. Mast 48 may be removed from post 44 by sliding mast 48 off the upper end of post 44, when the chain is disconnected therefrom. Thus, mast 48 is selectively removably connected to base assembly 14 to enable the puller device 10 to be raised and lowered relative to the cart 12 and raised or lower relative to the gear or the like to be pulled and enable the puller device to be positioned with respect thereto.

An electrically operated hydraulic pump means 50 is mounted on the cart 12 and is independently hydraulically connected to the hydraulic cylinder 18 and to the cylinders 34, 36 and 38 to enable either the hydraulic cylinder 18 to be operated or to enable the cylinders 34, 36 and 38 to be operated. A conventional switching valve connected to hydraulic pump 50 will direct hydraulic power either to the hydraulic cylinder 18, or to cylinders 34, 36 and 38.

A lifting eye 52 is operatively secured to the base assembly 14 to enable the puller device 10 or the cart 12 to be raised by means of a bridge crane or the like to properly position the puller device 10 with respect to the gear to be pulled. Further, the entire apparatus may be vertically moved by means of a forklift referred to generally by the reference numeral 54 in FIG. 3.

Figure 3:
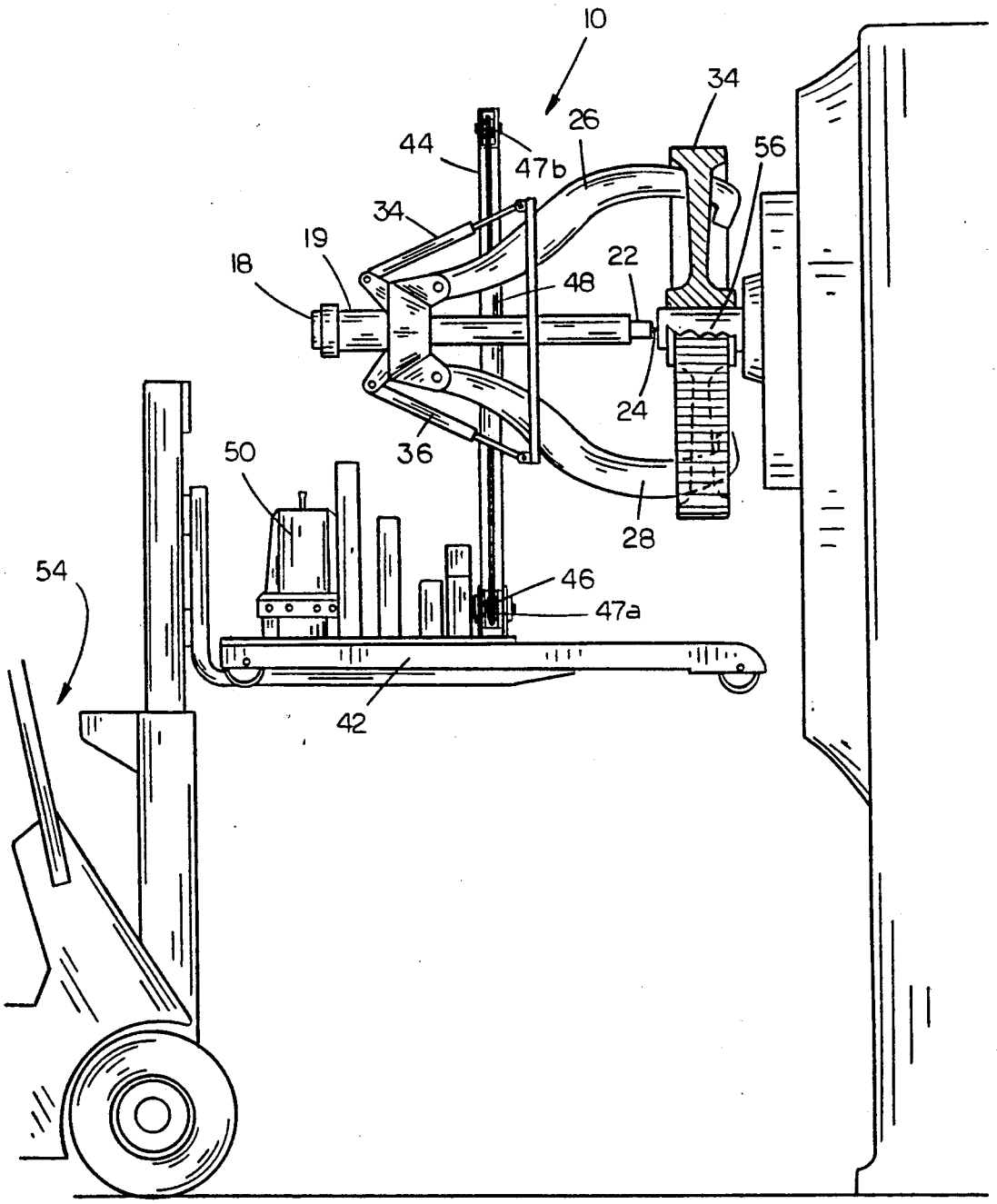
FIG. 3 is a view similar to FIG. 2 except that the hydraulic puller and transport cart have been vertically moved by means of a forklift.
Figure 4:
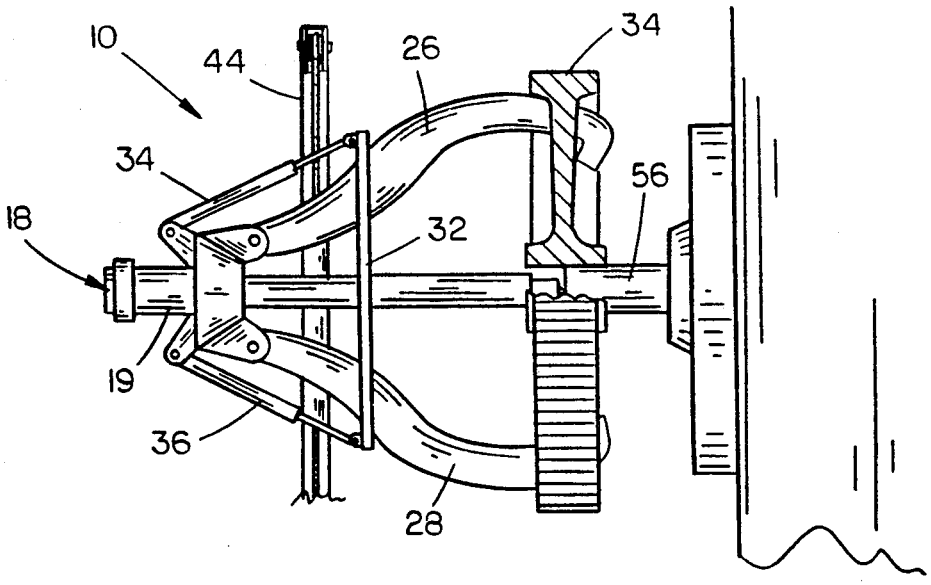
FIG. 4 is a side view illustrating the device of this invention clamp onto a gear to be pulled.

In operation, the puller device 10 is either maneuvered by the transport cart 12 or a bridge crane or the like so that the puller device 10 is positioned adjacent the gear to be pulled. The hydraulic cylinders, 34, 36 and 38 are hydraulically operated to pivotally move the jaws 26, 28 and 30 to properly position the jaws with respect to the gear 34 as illustrated in FIG. 3 so that the ends thereof are properly positioned relative to the gear. The hydraulic cylinders 34, 36 and 38 not only provide a convenient means for positioning the jaws 26, 28 and 30 but also ensure that the cam ring 32 will positively lock the jaws into pulling position during the pulling operation, since cylinders 34, 36 and 38 will be "locked" in position by hydraulic pressure.

When the jaws 26, 28 and 30 are positioned as illustrated in FIG. 3, hydraulic cylinder 18 is actuated to cause the ram 22 to be extended therefrom so that the pushing adapter 24 moves into engagement with the outer end of the shaft 56 upon which the gear 34 is positioned. Continued extension of the ram 22 from the hydraulic cylinder 18 causes the gear 34 to be pulled from the shaft 56.

The device of the present invention has many advantages over that disclosed in my parent application. One advantage is that the cam ring is hydraulically moved rather than the manual operation of the parent application. The puller device of this invention has a much greater capacity than the puller device of the parent application in that it is preferred that a one hundred ton cylinder 18 be used capable of exerting 10,000 pounds per square inch pressure. Further, the puller device of this invention, even though quite large and heavy, may be easily moved into position by either the transport cart, forklift or bridge crane The hydraulic cylinder 18 is quickly and easily removable from the base assembly so that the hydraulic cylinder 18 may be repaired or replaced as required without a complete disassembly of the remaining components of the puller device.

Thus it can be seen that the invention accomplishes at least all of its stated objectives.

I claim:

1. A hydraulically powered puller device for pulling a gear from a shaft, comprising, a base assembly including a housing with a head end, a butt end and a cylindrical opening formed therethrough extending from the head end to the butt end, at least first and second jaws operatively pivotally secured to said base assembly in a radial fashion with respect to the longitudinal axis of the cylindrical opening for engagement with the gear, a cam ring movably embracing said first and second jaws for effecting pivotal movement of said jaws in a radial direction as said cam ring is moved in a longitudinal direction relative to said base assembly, a first hydraulic cylinder operatively pivotally secured between said base assembly and said cam ring, a second hydraulic cylinder operatively pivotally secured between said base assembly and said cam ring, a third hydraulic cylinder operatively pivotally secured between said base assembly and said cam ring, said first, second and third hydraulic cylinders being uniformly spaced apart to cause longitudinal movement of said cam ring when activated, a puller hydraulic cylinder mounted in said cylindrical opening of said base assembly and having a ram means movably extending therefrom for engagement with the shaft, and means for operating and controlling said first hydraulic cylinder, said second hydraulic cylinder, said third hydraulic cylinder and said puller hydraulic cylinder, said operating and controlling means including a switch valve for directing hydraulic power to either said puller cylinder or said first, second and third cylinders.

2. The device of claim 1 wherein said puller hydraulic cylinder is removably mounted in said base assembly.

3. The device of claim 1 further including a transport cart means including a wheeled base having a frame member extending upwardly therefrom, said base assembly being operatively vertically movably mounted on said frame member.

4. The device of claim 1, further comprising:

a third jaw operatively pivotally secured to said base assembly in a radial fashion with respect to the longitudinal axis of the cylindrical opening;

said first, second and third jaws being uniformly spaced apart around said base assembly.

5. The device of claim 4, wherein said cam ring has a generally triangular shape with said first, second and third jaws embraced at apices of the cam ring, and said first, second and third hydraulic cylinders being pivotally secured to said cam ring at the apices thereof.

6. The device of claim 3 further including means for selectively vertically moving said base assembly relative to said frame member.

7. The device of claim 6 further including a lifting bracket means operatively secured to said base assembly.

* * * * *